United States Patent [19]

Tamura et al.

[11] 4,356,896

[45] Nov. 2, 1982

[54] ELEVATOR TERMINAL DECELERATION SYSTEM

[75] Inventors: Koichi Tamura; Ryuichi Kajiyama; Shigemi Iwata, all of Inazawa, Japan

[73] Assignee: Mitsubishi Denki Kabushiki Kaisha, Tokyo, Japan

[21] Appl. No.: 208,129

[22] Filed: Nov. 13, 1980

[30] Foreign Application Priority Data

Nov. 28, 1979 [JP] Japan ..... 54-154107

[51] Int. Cl.[3] ..... B66B 1/30

[52] U.S. Cl. ..... 187/29 R

[58] Field of Search ..... 187/29

[56] References Cited

U.S. PATENT DOCUMENTS

| | | | |
|---|---|---|---|
| 3,051,267 | 8/1962 | Borden | 187/29 |
| 3,410,367 | 11/1968 | Bradley et al. | 187/29 |
| 3,474,886 | 10/1969 | Iordanidis | 187/29 |
| 3,779,346 | 12/1973 | Winkler | 187/29 |
| 3,814,216 | 6/1974 | Pisatowski | 187/29 |
| 4,128,141 | 12/1978 | Caputo et al. | 187/29 |
| 4,161,236 | 7/1979 | Husson | 187/29 |
| 4,225,015 | 9/1980 | Yamada | 187/29 |

*Primary Examiner*—J. V. Truhe
*Assistant Examiner*—W. E. Duncanson, Jr.
*Attorney, Agent, or Firm*—Wenderoth, Lind & Ponack

[57] ABSTRACT

A system which includes a micro-computer which is responsive to an elevator car reaching a predetermined distance from a terminal floor and arranged to calculate a residual distance between the actual position of the car and the floor so as to generate a command normal deceleration signal concerning that distance, and a command terminal deceleration generator which is responsive to the successive actuations of plural terminal sensors disposed adjacent of the floor within an associated hoistway so as to generate a command terminal deceleration signal which is successively decreased. When the car engages any of the terminal sensors, the micro-computer similarly calculates a residual distance between the position of the engaged terminal switch and the floor so as to generate a command auxiliary terminal deceleration signal concerning that distance.

1 Claim, 4 Drawing Figures

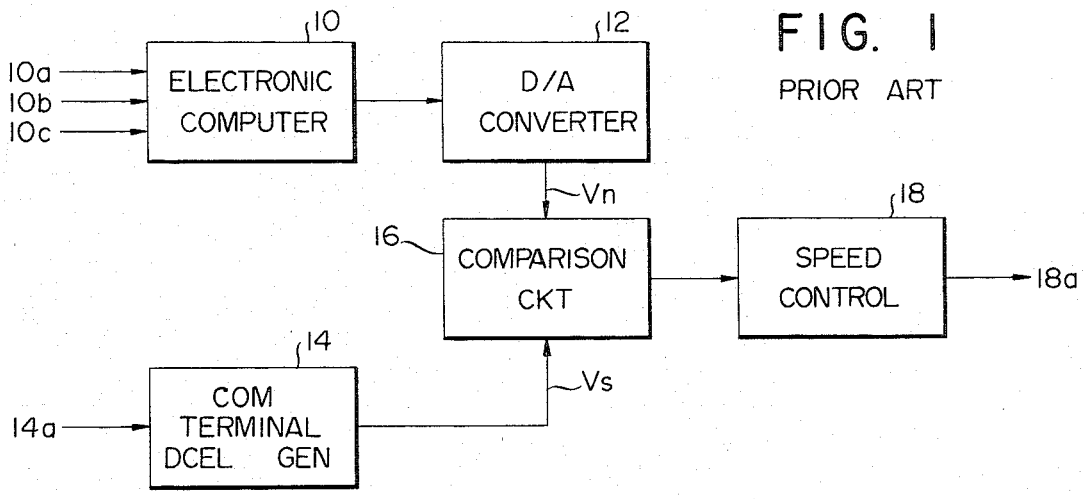
FIG. 1
PRIOR ART
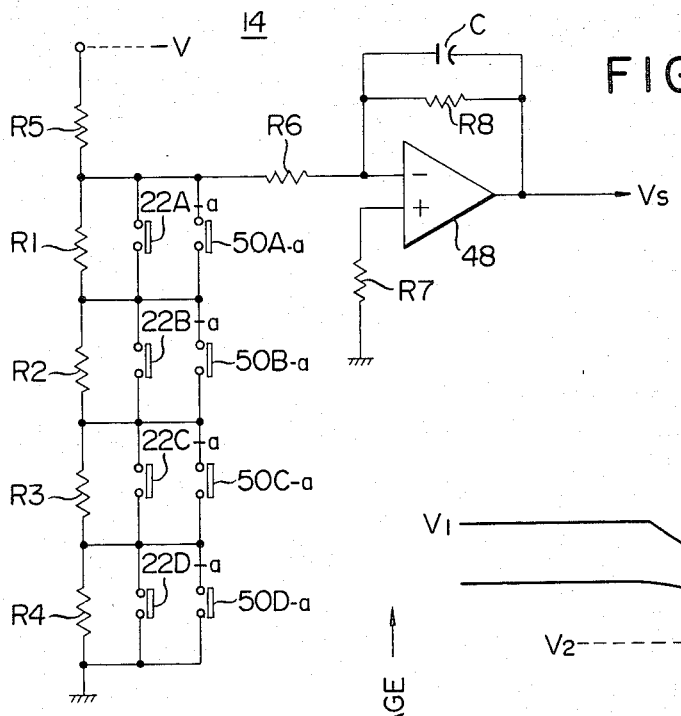
FIG. 4
FIG. 2
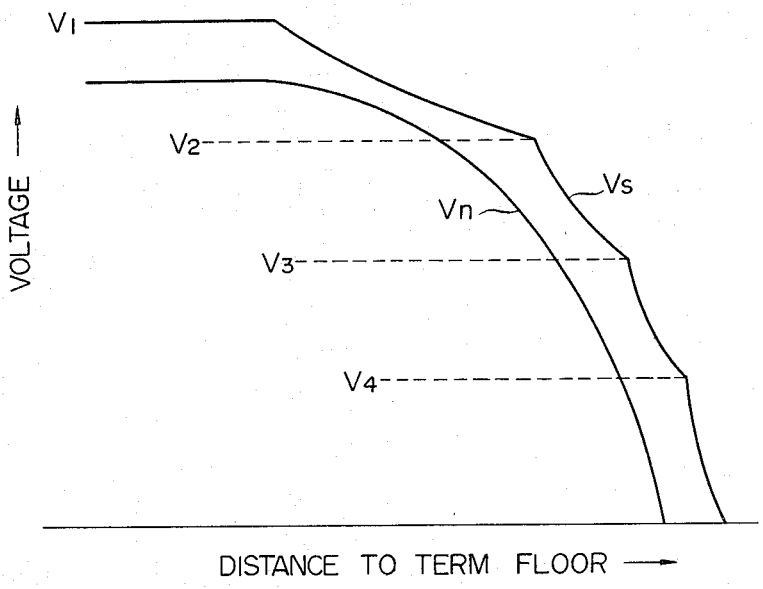

ELEVATOR TERMINAL DECELERATION SYSTEM

BACKGROUND OF THE INVENTION

This invention relates to improvements in an elevator terminal deceleration system for decelerating and landing an elevator car at a terminal floor.

Speed feedback control systems for controlling the speed of the elevator car in accordance with a command deceleration signal are employed in order that the elevator car is decelerated with a comfortable ride maintained and lands accurately at that floor of a building on which the car is predetermined to be stopped due to a call registered thereon or registered on the elevator car. It has been recently proposed that an electronic computer be used to cause the elevator car to decelerate and land at such a predetermined floor.

To this end, there have been various types of elevator terminal deceleration systems already proposed. One type of the proposed elevator terminal deceleration systems has comprised counter means for counting pulses corresponding to a distance of movement of an elevator car, and an electronic computer for receiving a count from the counter means upon the elevator car reaching a predetermined distance short of a terminal floor to subtract the count from the predetermined distance preliminarily stored therein so as to calculate a residual distance to the terminal floor and to generate a command normal deceleration signal having a magnitude successively decreased in accordance with the calculated residual distance.

On the other hand, when the elevator car approaches the terminal floor to successively engage a plurality of terminal sensors disposed adjacent to the terminal floor within an associated hoistway, a command terminal deceleration generator means generates a command terminal deceleration signal having a magnitude successively decreased in accordance with the actual position of the elevator car and always higher than that of the command normal deceleration signal. Then, a comparison circuit means compares the command normal deceleration signal with the command terminal deceleration signal to deliver the smaller of the two signals. The elevator car safely decelerates and lands at the terminal floor in accordance with the smaller signal or the command normal deceleration signal.

If the command normal deceleration signal is equal to or greater than the command terminal deceleration signal for some reason, for example, an error in a positional signal indicating the actual position of the elevator car, then the former signal similarly controls the elevator car to decelerate and land at the terminal floor.

However, the number of terminal sensors has been limited so as to make it difficult to smoothly change the resulting command terminal deceleration signal, resulting in an uncomfortable ride. In order to prevent any malfunction, the command terminal deceleration signal may also be distant from the command normal deceleration signal. However, this has caused an increase in delay relative to the command normal deceleration signal, resulting in the deterioration of the landing accuracy.

Accordingly, it is an object of the present invention to provide a new and improved elevator terminal deceleration system by which an elevator car can decelerate and land at a terminal floor with a high landing accuracy while a comfortable ride is maintained even upon the occurrence of a fault on either a positional signal indicating the actual position of the elevator car and a call sensing signal indicating which of floors has a call registered thereon or registered on the elevator car.

SUMMARY OF THE INVENTION

The present invention provides an elevator terminal deceleration system comprising: an elevator car, a plurality of terminal sensors disposed at predetermined equal intervals adjacent to a terminal floor in an associated hoistway, a counter means for counting pulses corresponding to a distance of movement of the elevator car, a means responsive to the elevator car, reaching a predetermined distance short of the terminal floor and arranged to receive a count from the counter means so as to subtract the count from the predetermined distance preliminarily stored therein to calculate a residual distance between the actual position of the elevator car and the terminal floor and to generate a command normal deceleration signal having a magnitude which is successively decreased in accordance with the residual distance, a command terminal deceleration generator means responsive to the successive engagements of the elevator car with the plurality of terminal switches during the approach of the elevator car to the terminal floor to generate a command terminal deceleration signal having a magnitude which is successively decreased in accordance with the actual position of the elevator car and always greater than that of the command normal deceleration signal, a command auxiliary deceleration generator means responsive to the engagement of the elevator car with any of the terminal sensors to receive the count from the counter mans and to subtract the count from a distance between the engaged terminal sensor and the terminal floor so as to calculate a residual distance between the actual position and the terminal floor and to generate a command auxiliary terminal deceleration signal which is successively decreased in accordance with the residual distance.

BRIEF DESCRIPTION OF THE DRAWINGS

The present invention will become more readily apparent from the following detailed description taken in conjunction with the accompanying drawings in which:

FIG. 1 is a block diagram of a conventional elevator terminal deceleration system;

FIG. 2 is a graph illustrating voltages developed at various points in the arrangement shown in FIG. 1 and plotted in ordinate against a distance to a terminal floor in abscissa;

FIG. 4 is a circuit diagram of the details of the command terminal deceleration generator shown in FIG. 3.

DESCRIPTION OF THE PREFERRED EMBODIMENT

Figure 3:
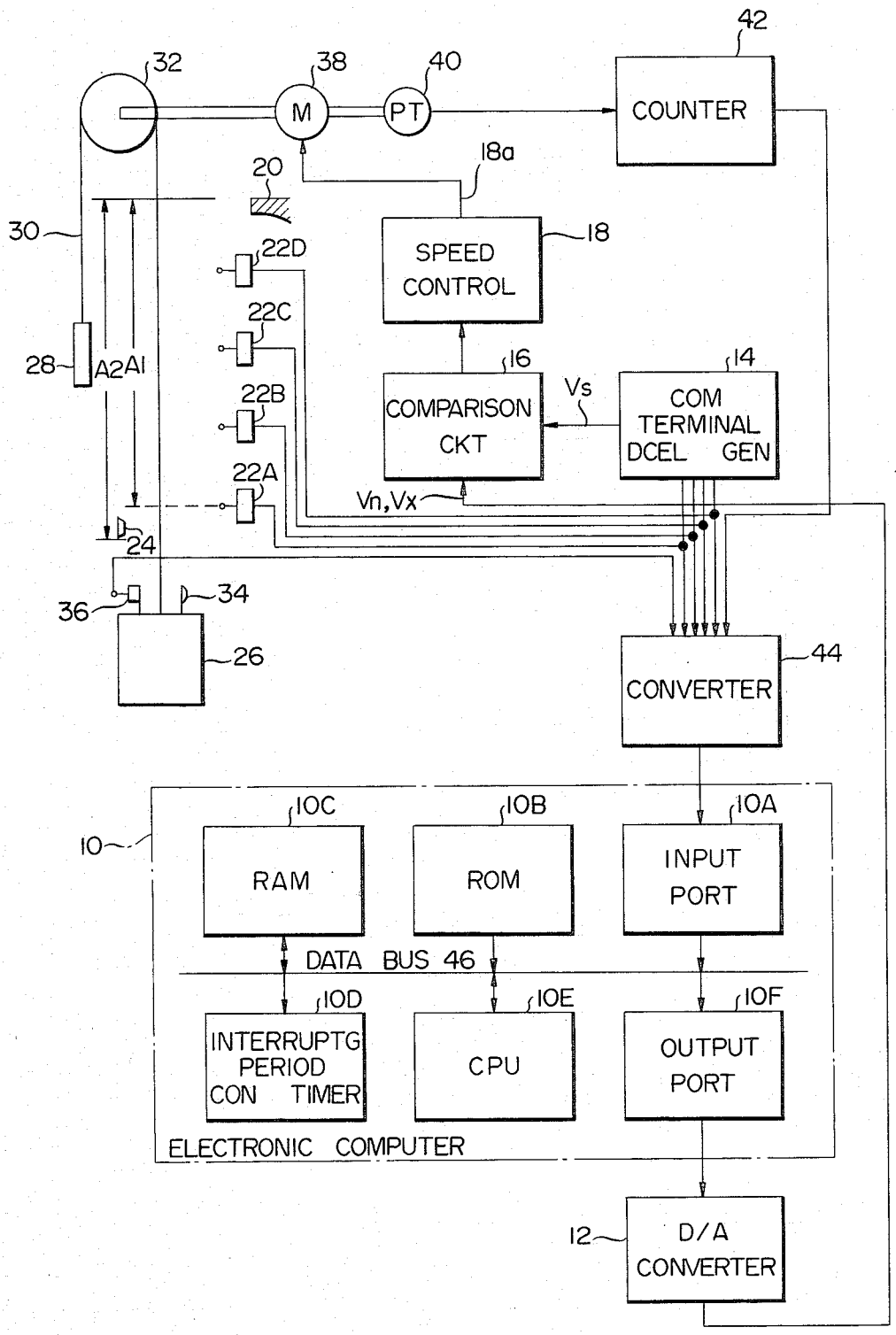
FIG. 3 is a block diagram of an embodiment according to the elevator terminal deceleration system of the present invention and a schematic view of an elevator system with which the present invention is operatively associated.

Referring now to FIG. 1 of the drawings, there is illustrated a conventional elevator terminal deceleration system. The illustrated arrangement comprises an electronic computer 10 supplied with a positional signal 10*a* for an involved elevator car (not shown) which is generated by counting pulses corresponding to a distance of movement thereof, a readiness-for-deceleration sensing signal 10b which is generated upon the elevator car reaching a predetermined distance short of that floor on which the elevator car is predetermined to be stopped due to a call registered thereon or registered on the elevator car and a calling sensing signal 10c for indicating the presence of the call.

The electronic computer 10 is connected to a digital-to-analog converter 12 where a digital signal from the electronic computer 10 is converted to a corresponding analog signal and a command normal deceleration signal $V_n$ is generated.

On the other hand, a command terminal deceleration generator 14 is connected to a comparison circuit 16 to which the digital-to-analog converter 12 is also connected. Then, the comparison circuit 16 is connected to a speed control device 18. The command terminal deceleration generator 14 successively receives terminal signals 14a generated upon the successive operations of a plurality of terminal sensors (not shown) disposed at predetermined equal intervals in a longitudinal or a vertical array within an associated hoistway (not shown) and adjacent to a terminal floor or adjacent to each of the uppermost and lowermost floors (not shown). The command terminal deceleration generator 14 responds to each of the terminal sensor signals 14a to generate a command terminal deceleration signal $V_s$ which is alwayer higher in magnitude than the command normal deceleration signal $V_n$. The comparison circuit 16 compares the command normal deceleration signal $V_n$ with the command terminal deceleration signal $V_s$ so that, when the $V_n$ is less than the $V_s$ as determined thereby, the command normal deceleration signal $V_n$ is delivered to the speed control device 18 and that, when the $V_n$ is equal to or greater than the $V_s$ as determined thereby, the command terminal deceleration signal $V_s$ is delivered to the speed control device 18.

When the elevator car reaches the predetermined distance short of that floor having a call registered thereon or registered on the elevator car, the electronic computer calculates a distance between the actual position of the elevator car and the abovementioned floor by using the positional signal 10a, the readiness-for-deceleration sensing signal 10b and the call sensing signal 10c. The floor is hereinafter called a "call floor" and the abovementioned distance is hereinafter called a "residual distance".

Then, a command deceleration magnitude preliminarily stored with respect to the calculated residual distance in the electronic computer is read out and generated as a command normal deceleration signal $V_n$. That command normal deceleration signal $V_n$ is applied to the speed control device 18 through the comparator 16 and used to generate a control signal 18a therefrom. Then, the elevator car decelerates and lands at the call floor in accordance with the control signal 18a.

While the process as described is repeated with a terminal floor, the command terminal deceleration signals $V_s$ are successively generated as the elevator car approaches the terminal floor. The successive command terminal deceleration signals $V_s$ and the command normal deceleration signal $V_n$ are substantially as shown in FIG. 2 wherein there are illustrated various voltages plotted in ordinate against a distance to the terminal floor in abscissa.

If the positional signal 10a and/or the readiness-for-deceleration sensing signal 10b are or is erroneously generated and/or if a faults or a fault occur or occurs on a central processor disposed in the electronic computer 10, a command normal deceleration generator disposed therein and/or the digital-to-analog converter 12, then the command normal deceleration signal $V_n$ may be equal to or greater than the command terminal deceleration signal $V_s$. In that case, the comparison circuit 16 delivers the command terminal deceleration signal $V_s$ to the speed control device 18, as described above, and the elevator car safely decelerates and lands at the terminal floor in accordance with the command terminal deceleration signal $V_s$.

However, the number of terminal sensors has its upper limit and therefore, the resulting command terminal deceleration signal $V_s$ has a small number of discontinuities with the result that it is difficult to smoothly change the command terminal deceleration signal $V_s$. Accordingly, an uncomfortable ride results.

Also, in order to prevent any malfunction, the command terminal deceleration signal $V_s$ may be distant from the command normal deceleration signal $V_n$. This causes an increase in time delay relative to the command normal deceleration signal $V_n$, resulting in the deterioration of the landing accuracy.

Referring now to FIG. 3, wherein like reference numerals designate the components identical to those shown in FIG. 1, there is illustrated one embodiment according to the elevator terminal deceleration system of the present invention. The illustrated arrangement comprises the uppermost floor 20, a plurality of terminal switches, in this case, four switches disposed at predetermined equal intervals into a longitudinal or a vertical array adjacent to the uppermost floor 20 within to form an associated hoistway (not shown). Those four switches, having main and auxiliary contacts, form four terminal sensors 22A, 22B, 22C and 22D. The lowermost terminal sensor 22A as viewed in FIG. 3 is located at a first predetermined distance $A_1$ short of the uppermost floor 20 and an up readiness-for-deceleration sensing cam 24 is also disposed in the hoistway at a second predetermined distance $A_2$ short of the floor 20.

An elevator car 26 is connected to a counterweight 28 through a traction rope 30 trained over a hoist wheel 32. The elevator car is provided on the outer surface of the ceiling thereof with both a terminal sensing cam 34 for selectively engaging the terminal sensors 22A, 22B, 22C and 22D and a readiness-for-deceleration sensing switch forming a readiness-for-deceleration sensor for engaging the cam 24 during the ascent of the elevator car. The hoist wheel 32 is connected to a hoist electric reversible motor 38. When driven in one of the opposite directions, the motor 38 moves upwardly the elevator car 26 by means of the hoist wheel 32 and the traction rope 30. During this upward movement of the elevator car 26, the readiness-for-deceleration sensor 36 first engages the associated cam 24 and then the terminal sensing cam 34 successively engages the terminal sensors 22A through 22D.

The arrangement further comprises pulse generator 40 which is directly connected to the hoist motor 38 so as to generate pulses whose number is proportional to that of rotation of the hoist motor 38 and therefore proportional to a distance of movement of the elevator car 26. The pulse generator 40 is connected to a counter 42 for counting the pulses generated by the same. Then, the counter 42 is connected to an electronic computer 10 through a converter 44 to which the auxiliary contacts of the terminal sensors 22A through 22D and the readiness-for-deceleration sensor 36 are connected.

The converter 44 is operative to convert an input applied thereto to data suitable for being processed by the electric computer 10 and apply the converted data to the computer 10.

In the illustrated example the electronic computer 10 has comprised a commercially available micro-computer, for example, a TYPE 8085A from the Intel Corporation. However, it is to be understood that the electronic computer may comprise any suitable micro-computer marketed, for example, as TYPE M6800 from the Motorola Corporation or as TYPE 80A from the Zilog Corporation or may comprise any other digital computer such as a small-sized computer.

The electronic computer or micro-computer 10 includes an input port 10A connected to the converter 44 and also to a data bus 46, and a read only memory device (which is abbreviated hereinafter to an "ROM") 10B, a random access memory device (which is abbreviated hereinafter to an "RAM") 10C, an interrupting period control timer 10D, a central processor 10E and an output port 10F connected to the data bus 46. The input port 10A and the ROM 10B are arranged to supply data to the data bus 46 while the timer 10D and the output port 10F are arranged to receive data from the data bus 46. The RAM 10C and central processor 10E are arranged to supply and receive data to and from the data bus 46.

In the illustrated example, the input port 10A, the ROM 10B, the RAM 10C, the timer 10D, the central processer 10E and the output port 10F are of TYPES 8212, 2716, 2114A, 8155, 8085A and 8212 commercially available from Intel, respectively.

The output port 10F is then connected to a digital-to-analog converter 12 which is subsequently connected to a comparison circuit 16 to which a terminal deceleration generator 14 is also connected. The comparison circuit 16 is connected to a speed control device 18 subsequently connected to the hoist motor 38 as in the arrangement of FIG. 1.

The terminal deceleration generator 14 is preferably of a circuit configuration as shown in FIG. 4. In the illustrated arrangement, a series combination of a plurality of resistors, in this case, four resistors $R_1$, $R_2$, $R_3$ and $R_4$ is connected between a voltage source $-V$ and ground through a resistor $R_5$ connected directly to the voltage source $-V$. Each of the resistors $R_1$, $R_2$, $R_3$ or $R_4$ is connected across an associated one of the serially connected main contacts of the terminal sensors 22A-a through 22D-a for the uppermost floor and also an mating one of serially connected terminal sensors 50A, 50B, 50C and 50D for the lowermost floor (not shown) identical to the terminal switches 22A, 22B, 22C and 22D respectively. For example, the resistor $R_2$ is connected across the terminal sensor 22B-a and also across the terminal sensor 50B-a.

The junction of the resistor $R_1$, and the terminal switches 22A-a and 50A-a is connected via a resistor $R_6$ to a negative input (−) of an operational amplifier 48 having its other or positive input (+) connected to ground through a resistor $R_7$. The output of the operational amplifier 48 is connected to the negative input through a parallel combination of a capacitor C and a resistor $R_8$ forming a negative feedback network.

The operation of the arrangement shown in FIG. 3 will now be described. When the elevator car 26 ascends, the pulse generator 40 generates the pulses which are, in turn, counted by the counter 42. Meanwhile, the elevator car 26 reaches the second predetermined distance $A_2$ short of the uppermost floor 20, which is a call floor, whereupon the readiness-for-deceleration sensor 36 engages the cam 24. Therefore, the sensor 36 generates readiness-for-deceleration sensing signal. That signal is converted to data for the micro-computer 10 by the converter 44. The central processor 10E senses the converted data through the input port 10A and the data bus 46 to read out from the ROM 10B the distance $A_2$ stored therein and write it into the RAM 10C at an address predetermined therefor.

Thereafter, a count on the counter 42 is entered into the micro-computer 10 through the converter 44 for each of the calculating time periods. The central processer 10E subtracts the entered count from the distance $A_2$ written into the RAM 10C to thereby calculate a residual distance to the uppermost floor 20.

Then, the central processer 10E reads out successively from the ROM 10B command deceleration magnitudes which are successively decreased in accordance with the residual distances thus calculated. The command deceleration magnitudes read out the ROM 10B are successively supplied to the output port 10F and thence to the digital-to-analog converter 12 where the deceleration magnitudes are successively converted to corresponding analog magnitudes. The analog magnitudes are successively applied, as a command normal deceleration signal $V_n$, to the speed control device 18 through the comparison circuit 16 to thereby control the hoist motor 38. Accordingly, the elevator car 26 is smoothly decelerated until it lands accurately at the floor 20.

On the other hand, all the terminal sensors 22A through 22D are in their open position before the elevator car 26 approaches the uppermost floor 20. Under these circumstances, the operational amplifier 48 produces an output or a command terminal deceleration signal $V_s$ having a magnitude $V_1$ expressed by $$V_1 = V \times \frac{R_1 + R_2 + R_3 + R_4}{R_5 + R_1 + R_2 + R_3 + R_4} \times \frac{R_8}{R_6}$$

where V designates an input signal voltage.

Then, the elevator car 26 reaches the first predetermined distance $A_1$ short of the uppermost floor 20, whereupon a first one of the terminal sensor 22A engages the cam 34 resulting in the closure of the terminal sensor 22A. The closure of the terminal sensor 22A generates the command terminal deceleration signal $V_s$ having a magnitude $V_2$ expressed by $$V_2 = V \frac{R_2 + R_3 + R_4}{R_5 + R_2 + R_3 + R_5} \times \frac{R_8}{R_6}$$

The magnitude $V_2$ is smaller than the magnitude $V_1$. In this way, the terminal sensors 22B, 22C and 22D are successively closed to cause the operational amplifier 48 to successively provide outputs having magnitudes $V_3$, $V_4$ . . . which are successively decreased as shown at dotted line in FIG. 2.

Under these circumstances, when the command normal deceleration signal $V_n$ is not erroneous, and $V_n < V_s$. This means that the elevator car 26 decelerates and lands at the uppermost floor 20 in accordance with the command normal deceleration signal $V_n$.

On the other hand, when the first terminal sensor 22A engages the cam 34 to produce an output which is, in turn entered into the micro-computer 10 through the converter 44. This results in the repeating of the process as described above in conjunction with the closure of the readiness-for-deceleration sensor 36 excepting that the first predetermined distance $A_1$ is read out from the ROM 10B and written into the RAM 10C. As a result, a command auxiliary terminal deceleration signal $V_x$ concerning a calculated residual distance is supplied through the digital-to-analog converter 12 to the comparison circuit 16. Each time the terminal sensors 22B through 22D are successively closed, the process as described above is repeated to similarly supply to the comparison circuit the command auxiliary terminal deceleration signal $V_x$ having a magnitude which is successively decreased in accordance with residual distances.

Accordingly, even if the command normal deceleration signal $V_n$ would be erroneous due to a fault occuring on at least one of the readiness-for-deceleration sensing cam 24 and the terminal sensor 36, it is possible to decelerate and land the elevator car at the uppermost floor in accordance with the command auxiliary terminal deceleration signal $V_x$. In addition, the command auxiliary signal $V_x$ has a magnitude similar to that of the command normal deceleration signal $V_n$. This prevents the comfortable ride on the elevator car from deteriorating.

In other words, when the elevator car reaches the second predetermined distance A2 short of the upper most floor 20 which is a call floor, the readiness-for-deceleration sensor 36 or position sensor engages the cam 24 to initiate the calculation of a residual distance. This results in the delivery of the command normal deceleration signal Vn. On the other hand, the command auxiliary terminal deceleration signal Vx is calculated when the terminal sensor 22 engages the cam 34 and is then delivered. The two signals Vn and Vx are then compared within the central processing unit 10E so that the signal Vn is applied to the digital-to-analog converter 12 through the output port 10F when $Vn < Vx$, and the signal Vx is similarly applied to the converter 12 when $Vn \geqq Vx$.

Each of the terminal sensors 22A through 22D has generally an error in its location and the error becomes larger as the terminal sensor is farther remote from the uppermost floor 20. This results in a fear that the landing accuracy is decreased. However, the landing accuracy can be improved by using all of some of the terminal sensors except for the first terminal sensor 22A to correct residual distances during the ascent of the elevator car.

Should the worst case happen where both the command normal deceleration signal $V_n$ and the command auxiliary deceleration signal $V_x$ are erroneous, the elevator car safely decelerates and lands at the uppermost floor in accordance with the command terminal deceleration signal $V_s$ after the signal $V_n$ has been equal to or greater than the signal $V_s$ as described above.

While the present invention has been illustrated and described in conjunction with the uppermost floor it is to be understood that the same is equally applicable to the lowermost floor. In the latter case, terminal sensors 50A-a through 50D-a (see FIG. 4) are actuated instead of the terminal sensors 22A-a through 22D-a.

From the foregoing it is seen that the present invention provides an elevator terminal deceleration system comprising means responsive to an elevator car reaching a predetermined distance short of a terminal floor to calculate a residual distance between the actual position of the elevator car and the terminal floor and for generating a command normal deceleration signal concerning the calculated residual distance, a command terminal deceleration generator means for generating a command terminal deceleration signal which is successively decreased in magnitude when the elevator car successively engages a plurality of terminal sensors disposed adjacent to the terminal floor within an associated hoistway, and a command auxiliary terminal deceleration generator means which is responsive to the engagement of the elevator car with any of the terminal sensors to calculate a residual distance between the position of the elevator car at that time and the terminal floor and to generate a command auxiliary terminal deceleration signal concerning the calculated residual distance.

Accordingly, even if the command normal deceleration signal would be erroneous, the elevator car can decelerate and land at the terminal floor with a high accuracy while a comfortable ride is maintained. This is substantially similar to the normal deceleration.

While the present invention has been illustrated and described in conjunction with a single preferred embodiment thereof, it is to be understood that numerous changes and modification may be resorted to without departing from the spirit and scope of the present invention.

What is claimed is:

1. An elevator terminal deceleration system comprising an elevator car, a plurality of terminal sensors disposed at predetermined equal intervals adjacent to a floor terminal within an associated hoistway, counter for counting pulses corresponding to a distance of movement of said elevator car means responsive to said elevator car reaching a predetermined distance short of said terminal floor to receive a count from said counter means, to subtract said count from said predetermined magnitude preliminarily stored therein to calculate a residual distance between the actual position of the elevator car and said terminal floor, and to generate a command normal deceleration signal having a magnitude successively decreased in accordance with said residual distance, command terminal deceleration generator means responsive to the successive engagement or said elevator car with said plurality of terminal sensors during the approach of said elevator car to said terminal floor to generate a command terminal deceleration signal having a magnitude successively decreased in accordance with the actual position of said elevator car and always higher than that of said command normal deceleration signal, and a command auxiliary terminal deceleration generator means responsive to the engagement of said elevator car with any of said terminal sensors to receive said count from said counter means to subtract said count from a distance between the engaged terminal sensor and said terminal floor, to calculate a residual distance between the actual position of said elevator car and said terminal floor and to generate a command auxiliary terminal deceleration signal successively decreased in accordance with said residual distance.

* * * * *